United States Patent [19]

Aoki

[11] 4,067,303

[45] Jan. 10, 1978

[54] FUEL INJECTION PUMP GOVERNOR

[75] Inventor: Hachiro Aoki, Higashi Matsuyama, Japan

[73] Assignee: Diesel Kiki Co., Ltd., Tokyo, Japan

[21] Appl. No.: 642,258

[22] Filed: Dec. 19, 1975

[30] Foreign Application Priority Data

| | | |
|---|---|---|
| Dec. 19, 1974 | Japan | 49-144984 |
| Dec. 19, 1974 | Japan | 49-144985 |
| Dec. 19, 1974 | Japan | 49-153264[U] |
| Dec. 19, 1974 | Japan | 49-153265[U] |
| Dec. 19, 1974 | Japan | 49-153266[U] |
| May 2, 1975 | Japan | 50-58893[U] |

[51] Int. Cl.[2] ..... F02D 1/04

[52] U.S. Cl. ..... 123/140 R; 123/140 J

[58] Field of Search ..... 123/140 R, 140 J, 140 MC

[56] References Cited

U.S. PATENT DOCUMENTS

| | | | |
|---|---|---|---|
| 3,330,265 | 7/1967 | Giraudon et al. | 123/140 R |
| 3,530,845 | 9/1970 | Staudt et al. | 123/140 R |
| 3,903,860 | 9/1975 | Maier | 123/140 R |
| 3,923,026 | 12/1975 | Aoki | 123/140 R X |
| 3,924,594 | 12/1975 | Aoki | 123/140 R X |
| 3,938,488 | 2/1976 | Aoki | 123/140 R |

*Primary Examiner*—Charles J. Myhre
*Assistant Examiner*—Tony M. Argenbright
*Attorney, Agent, or Firm*—Edward F. Connors

[57] ABSTRACT

Flyweights are connected to a fuel control rod through a tension lever and a floating lever. A speed control lever is connected to the floating lever so that the engine speed is determined by the rotational speed of the flyweights and the position of the speed control lever in combination. A governor spring is compressed between two spring seats which are slidably carried on a governor rod, and the tension lever moves against the force of the governor spring by engaging with one of the spring seats. A nut is threaded on the governor rod and retains the spring seat opposite to the tension arm. A pin integral with the nut is slidable in a groove in the governor housing so that the nut may move only axially. An end of the governor rod extends out through the housing so that rotation of the governor rod adjusts the compressive preload of the governor spring. The governor, which is basically an all-speed governor, may thus be made to function as a high-low speed governor. A fuel limiting lever is moved by the spring seat assembly to limit movement of the fuel control rod and thereby the maximum fuel injection volume. Latching means actuated by the tension lever latch the fuel limiting lever in a reduced fuel position after the flyweight speed increases above a predetermined value so that an overly rich fuel mixture may be provided for starting. In one embodiment of the governor the fuel limiting lever is actuated by a cam which provides an optimum maximum fuel injection volume at all speeds.

29 Claims, 13 Drawing Figures

FUEL INJECTION PUMP GOVERNOR

The present invention relates to a fuel injection pump governor especially suited to a compression ignition or Diesel engine.

Fuel injection pump governors are usually provided either as all-speed or high-low speed types. However, it is often desirable to operate a governor in an all-speed mode under certain conditions and in a high-low speed mode under other conditions. For example, a powdered coal loader or a wheeled crane is not conveniently operated in an all-speed mode while performing its function and in a single speed mode for transportation.

It is also desirable to conveniently adjust the preload of the governor spring from outside of the governor. The maximum speed of a new engine can be limited during the break-in period by reducing the preload of the governor spring and made normal by increasing the preload after the break-in period is completed. Prior art governors do not provide the above functions in a convenient manner.

It is also necessary with a compression ignition engine to provide an over-rich fuel mixture for starting. The mixture must be reduced after the starting period is completed or the engine will emit black smoke which pollutes the atmosphere and represents a waste of expensive fuel. Prior art governors sometimes employ a spring to oppose the force of a starting spring to limit the fuel injection volume. However, these governors do not allow a sufficiently rich fuel mixture for sure and easy starting.

Prior art governors futher resort to a compensating spring in an attempt to provide the correct fuel injection volume in a range between idling and medium speed. However, due to the complicated fuel requirements of modern compression ignition engines, such a compensating spring is not sufficient to ensure the correct amount of fuel injection under all engine operating conditions.

It is therefore an object of the present invention to provide a governor for a fuel injection pump for a compression ignition engine which allows conversion of the governor from all-speed operation to high-low speed operation by simply rotating a screw member which extends outside of the governor housing.

It is another object of the present invention to provide a governor which allows adjustment of the preload of the governor spring and thereby the maximum speed from outside the governor housing by simply rotating a screw member.

It is another object of the present invention to provide a governor which comprises means for limiting the maximum fuel injection volume to a maximum value during starting the engine and automatically reduces the maximum fuel injection volume to a lower value after the engine is started.

It is another object of the present invention to provide a governor which comprises a latching mechanism in combination with a compensating spring to provide an optimum fuel injection volume at low speeds.

It is another object of the present invention to provide a governor which comprises a cam mechanism to limit the maximum fuel injection volume below a value at which smoky exhaust gas is produced at all speeds and at all positions of a speed control lever.

The above and other objects, features and advantages of the present invention will become clear from the following detailed description of various embodiments thereof taken in conjunction with the accompanying drawings, in which.

Figure 1:
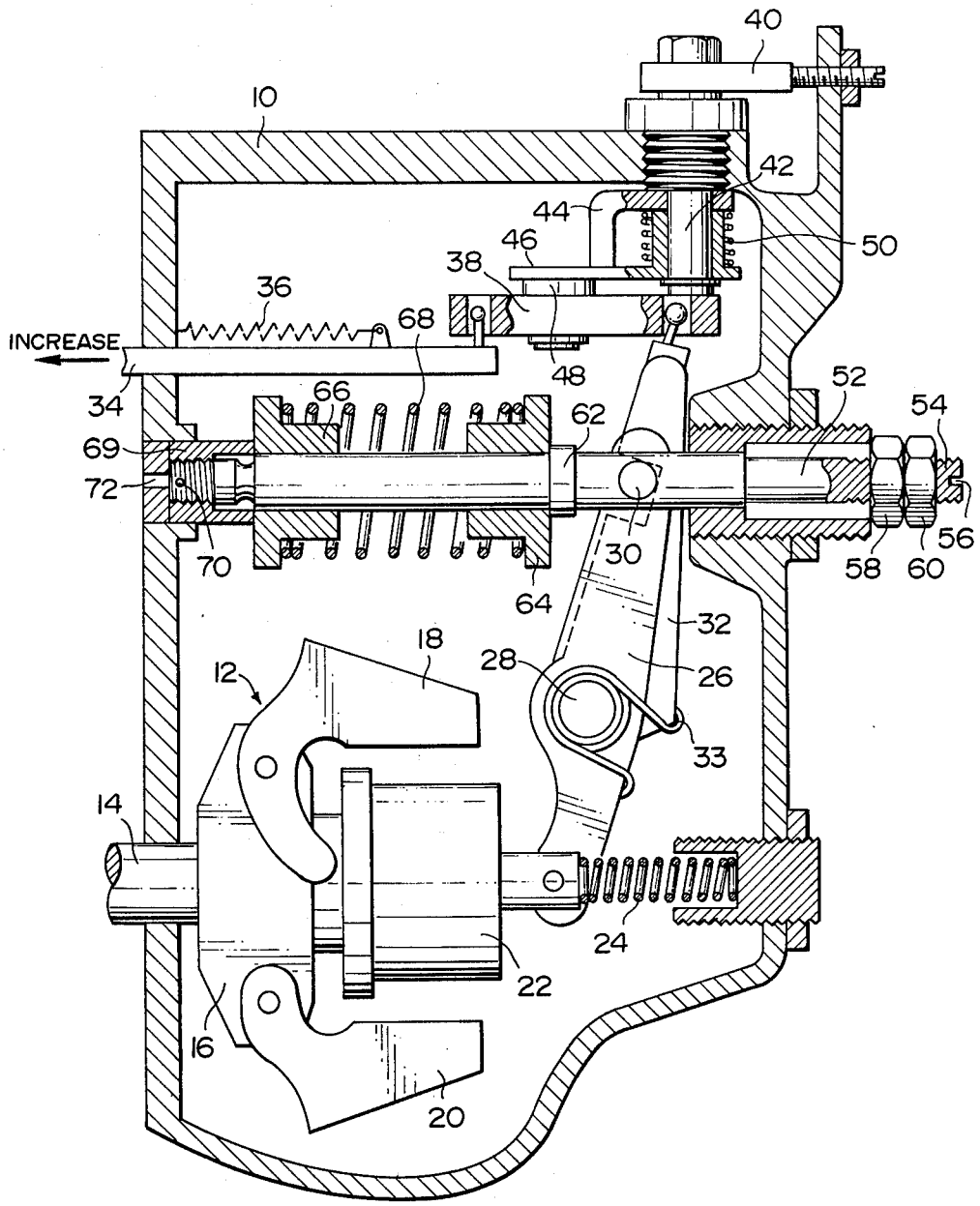
FIG. 1 is a sectional view of the most basic configuration of a governor in accordance with the present invention.

Referring now to FIG. 1, a governor embodying the present invention comprises a housing 10. A flyweight assembly 12 comprises a shaft 14 which is adapted to be driven for rotation by a camshaft of a fuel injection pump of a compression ignition engine (not shown). A plate 16 is fixed to the shaft 14 for unitary rotation and flyweights 18 and 20 are pivotally connected to the plate 16. The flyweights 18 and 20 are L-shaped and are arranged to be flung outwards by centrigugal force as to move a shifter 22 rightward as viewed in FIG. 1. An idling spring 24 urges the shifter 22 leftward and the flyweights 18 and 20 toward their retracted positions. A first tension lever 26 is pivotal about a pivot pin 28 and is pivotally connected at its bottom end to the shifter 22. A pin 30 is fixed to the upper end of the first tension lever 26. A second tension lever 32 is also pivotal about the pivot pin 28 and is urged counterclockwise by a spring 33 so as to abut against the pin 30.

A fuel control rod 34 is urged leftward toward a maximum fuel position by a starting spring 36. The fuel control rod 34 is connected to the fuel injection pump to control the fuel injection volume in accordance with the position of the fuel control rod 34 in any known manner.

A floating lever 38 is pivotally connected at one end to the fuel control rod 34 and at its other end to the second tension lever 32. A speed control lever 40 is supported by the housing 10 by means of a shaft 42 which is fixed to the control lever 40 and rotatable therewith. A first arm 44 is also fixed to the shaft 42. A second arm 46 is rotatably carried by the shaft 42 and has a pin 48 fixed to its end which is pivotally connected to support the floating lever 38 at an intermediate point thereof. A spring 50 urges the second arm 46 to rotate into abuttment with the first arm 44.

A governor rod 52 is slidably supported by the housing 10 and extends external thereof at one end 54 which is formed with a screwdriver slot 56. The end 54 of the rod 52 is threaded to receive a retaining nut 58 and a locknut 60. The retaining nut 58 normally abuts, in this most basic embodiment, against the right side of the housing 10.

The governor rod 52 is formed with a shoulder 62. A first spring seat 64 is slidably carried by the rod 52 and is abutable against the shoulder 62 so that rightward movement of the first spring seat 64 past the shoulder 62 is not possible. A second spring seat 66 is also slidably carried by the governor rod 52 and a governor compression spring 68 is operatively disposed between the spring seats 64 and 66. A nut 69 is slidably supported by the housing 10 and is threaded on the governor rod 52.

Figure 2:
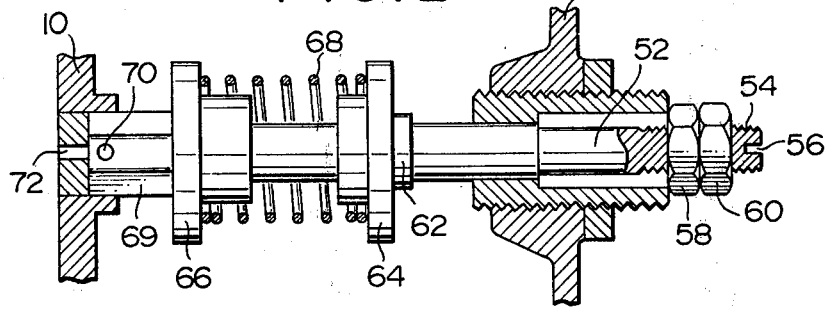
FIG. 2 is an enlarged view of part of the governor shown in FIG. 1 which allows conversion of the governor from an all-speed mode to a high-low speed mode and also allows adjustment of the preload of a governor spring from outside a governor housing.

As more clearly seen in FIG. 2, a pin 70 radially extends from the nut 69 and is slidable in an axial slot 72 formed in the housing 10. In this manner, the nut 69 is axially movable but is prevented from rotation by the pin 70 and slot 72.

Figure 3:
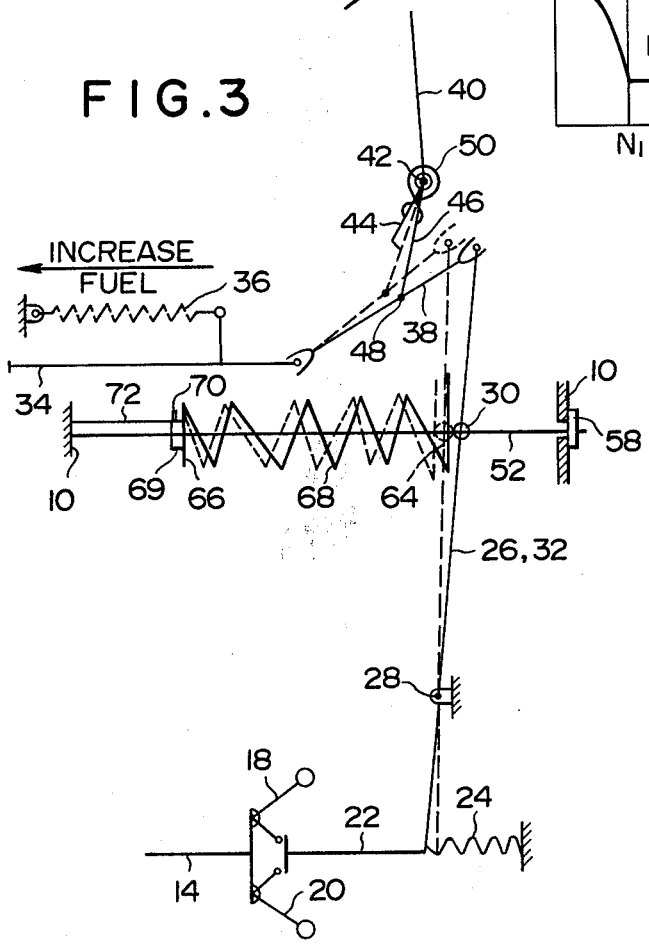
FIG. 3 is a graphic view of the governor shown in FIG. 1 showing the operation thereof under maximum speed conditions.

The operation of the governor will now be described with reference also being made to FIG. 3. For simplicity of illustration, the floating lever 38, speed control lever 40 and arms 44 and 46 are shown as being rotatable in a vertical plane in FIG. 3 rather than in a horizontal plane as in FIG. 1. The operation is, however, equivalent. The first and second tension levers 26 and 32 are shown in FIG. 3 as being integral. The spring 33 serves to prevent breakage of the mechanism.

With the engine at rest, the flyweights 18 and 20 are retracted by the idling spring 24 and the tension levers 26 and 32 are rotated to their maximum clockwise positions as viewed in FIG. 3. The speed control lever 40 is rotated to its maximum counterclockwise position. The floating lever 38 is in its maximum counterclockwise position pulling the fuel control rod 34 to its maximum rightward or fuel shut-off position. The pin 30 is disengaged from the first spring seat 64.

To start the engine, the operator rotates the speed control lever 40 to its maximum clockwise or maximum fuel injection position, thereby rotating the arm 44 in an integral manner. The arm 46 is urged by the spring 50 to rotate clockwise toward the arm 44. This moves the pin 48 leftward causing the floating lever 38 to pivot clockwise about its point of connection with the tension lever 32. This clockwise movement of the floating lever 38 causes the fuel control rod 34 to be moved to its most leftward or maximum fuel position until it abuts against a maximum fuel stop (not shown). In this condition, the components of the governor assume the positions shown in solid line in FIG. 3.

The operator then energizes a starter motor (not shown) to crank the engine. As combustion is initiated in the engine, the engine speed and thereby the rotational speed of the flyweights 18 and 20 increases. The shifter 22 is moved rightward against the force of the idling spring 24 causing the tension levers 26 and 32 to rotate counterclockwise about the pivot pin 28. The point of connection of the tension lever 32 and the floating lever 38 is moved leftward. Since, however, the fuel control rod 34 is prevented from further leftward movement by the maximum fuel stop, leftward movement of the upper end of the tension lever 32 will cause the floating lever 38 to pivot counterclockwise about its point of connection with the fuel control rod 34. This will move the pin 48 leftward causing the arm 46 to rotate clockwise toward the arm 44 as shown in broken line.

After the engine has been successfully started, the operator rotates the speed control lever 40 counterclockwise to an idling position. During this movement, the arm 44 abuts against the arm 46, rotating the same counterclockwise. This moves the pin 48 rightward cousing the floating lever 38 to pivot counterclockwise about its point of connection with the upper end of the tension lever 32 thereby pulling the fuel control rod 34 rightward to an idling position which is variable. With the arms 44 and 46 engaged, the pin 48 serves as a pivot for the floating lever 38. The governor in this condition serves to maintain the engine at a desired idling speed which is determined by the position of the speed control lever 40, and is independent of the engine load. For example, with the speed control lever 40 in an idling position range in which the arms 44 and 46 are engaged but the pin 30 is disengaged from the first spring seat 64, if the engine speed decreases due to an increase in the load, the shifter 22 will be moved leftward by the flyweights 18 and 20 thereby rotating the tension levers 26 and 32 clockwise about the pin 28. Since the pin 48 serves as a pivot for the floating lever 38, the floating lever 38 will be rotated clockwise thereabout moving the fuel control rod 34 leftward to increase the fuel injection volume. This will cause the engine to speed up to the desired idling speed.

Figure 4:
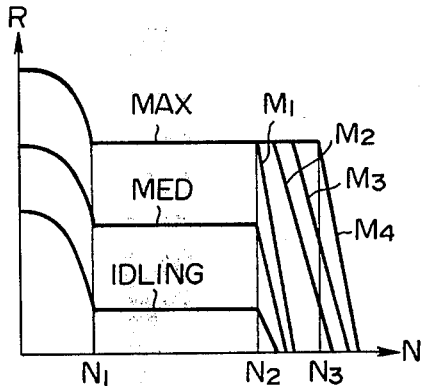
FIG. 4 is a graph illustrating the fuel injection characteristics of the governor shown in FIG. 1 and the manner in which the preload of the governor spring and thereby the maximum speed may be adjusted.

Referring also to FIG. 4, the position of the fuel control rod 34 in the increasing (leftward) direction is designated as R and is plotted as a function of engine (or flyweight 18 and 20) rotational speed N. At a speed $N_1$, the tension lever 26 is rotated counterclockwise by the flyweights 18 and 20 and the shifter 22 to an extent that the pin 30 just abuts against the springg seat 64. The tension lever 26 will not rotate further until the force of the flyweights 18 and 20 is sufficient to overcome the preload of the governor spring 68 at a speed $N_2$. Clockwise rotation of the speed control lever 40 will increase the leftward position of the fuel control rod 34 so that enough fuel is injected into the engine to increase the speed to a value between $N_1$ and $N_2$. Whereas an increase in speed causes rightward movement of the fuel control rod 34 in the idling range as shown in FIG. 4, the position of the fuel control rod 34 is independent of the engine speed between $N_1$ and $N_2$ since the tension lever 26 cannot move against the force of the governor spring 68. The engine speed is therefore controlled completely by the position of the speed control lever 40. In FIG. 4 is shown three characteristic curves for the governor of FIG. 1, with the control lever 40 in idling, medium and maximum speed positions respectively. It will be understood that clockwise rotation of the speed control lever 40 has the effect of shifting the characteristic curve upward, or in other words, the amount of fuel injected will be greater at any specified engine speed.

With the speed control lever 40 rotated clockwise to a position at which the arm 46 is engaged with the arm 44 and the engine speed is above $N_2$ such that the pin 30 is engaged with the spring seat 64 and the force of the flyweights 18 and 20 is sufficient to overcome the preload of the governor spring 68, a further increase in engine speed will cause the tension levers 26 and 32 to rotate counterclockwise against the force of the governor spring 68. The result is quite similar to that in the idling speed range in that the floating lever 38 is rotated counterclockwise about the pin 48 thereby moving the fuel control rod 34 rightward to decrease the fuel injection volume and reduce the engine speed to the desired value.

In accordance with an important feature of the present invention, lower and upper control speeds $N_1$ and $N_2$ respectively and thereby the maximum engine speed can be adjusted from outside the housing 10 in a simple manner. To adjust the upper control speed $N_2$, the locknut 60 is loosened, a screwdriver blade (not shown) is inserted in the screwdriver slot 56 and rotated. This causes rotation of the governor rod 52 through the nut 69, since rotation of the nut 69 is prevented by the pin 70 and slot 72, thereby varying the spacing between the right end of the nut 69 and the left end of the shoulder 62. With the nut 69 serving as a stop for the spring seat 66, the shoulder 62 serving as a stop for the spring seat 64 and the spacing between the spring seats 64 and 66 being such that the governor spring 68 is compressed therebetween, the preload of the governor spring 68 and thereby the upper control speed $N_2$ is adjusted simply by rotating the governor rod 52. To adjust the lower control speed $N_1$, the governor rod 52 is prevented from rotation by the screwdriver and the retaining nut 58 is rotated relative to the governor rod 52 to adjust the spacing between the shoulder 62 and the retaining nut 58. The locknut 60 is then tightened. Since the retaining nut 58 is maintained in engagement with the right side of the housing 10, the spacing between the shoulder 62 and the retaining nut 58 determines the speed at which the pin 30 will engage with the spring seat 64.

As shown in FIG. 4, curves $M_1$ to $M_4$ show how the upper control speed can be increased from $N_2$ to $N_3$ by increasing the preload of the governor spring 68 (by compressing the governor spring 68) as described above, with the control lever 40 in the maximum speed position.

By providing idling and maximum speed detents or stops (not shown) for the speed control lever 40, the govenor may be conveniently operated as a high-low speed governor.

For example, a wheeled crane can be operated with the governor in the all-speed mode and the upper control speed set at $N_2$ to prevent the engine from driving the crane arm at a dangerous speed, for work, and the govenor can be quickly converted to the high-low speed mode with the upper control speed set to the higher value $N_3$ for driving the crane to a new work site at a constant speed. The preload of the governor spring 68 can of course be conveniently reduced to limit the maximum engine speed while breaking-in a new engine, and then increased to the normal value after the break-in period is completed.

Figure 5:
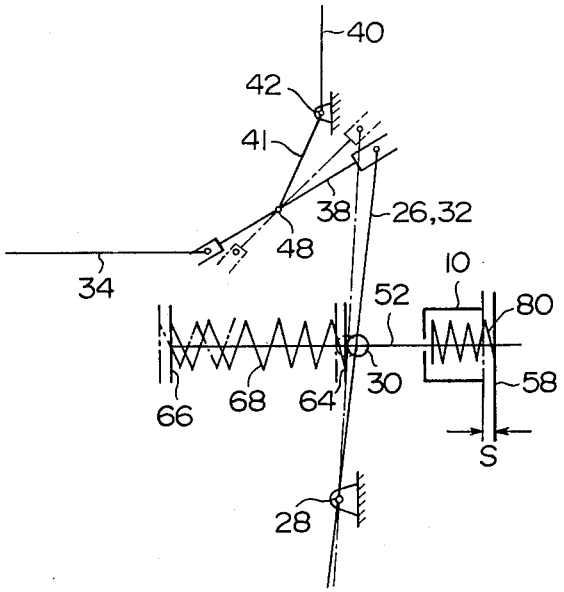
FIG. 5 is a graphic view of a simplified form of the governor of FIG. 1 which comprises, in combination, a compensating spring.

FIG. 5 shows a simplified embodiment of the invention which comprises, in combination, a compensating spring 80. The embodiment of FIG. 5 is very similar to that of FIG. 1, and the same reference numerals are used for identical components.

In FIG. 5, the arms 44 and 46 are replaced by single arm 41, which in integral with the speed control lever 40 and carries at its end the pin 48. The spring 80 attains its free length at low engine speeds, and a clearance S is provided between the right end of the spring 80 and the right side of the housing 10. The compensating spring 80 serves to further match the fuel injection volume provided by the governor to the requirements of the engine in the upper portion of the idling range (just below the lower control speed $N_1$).

With the speed control lever 40 in the idling position and the engine speed at a predetermined value below $N_1$, the tension levers 26 and 32 are rotated counterclockwise against the force of the idling spring 24 (not shown in FIG. 5) until the pin 30 just engages with the spring seat 64. The governor spring 68 is much stronger than the compensating spring 80, so further counterclockwise rotation of the tension lever 26 moves the first spring seat 64, governor spring 68, second spring seat 66 and governor rod 52 leftward against the force of the compensating spring 80 in addition to the force of the idling spring 24. When the governor rod 52 has moved leftward by the distance S, the nut 58 will abut against the housing 10 to prevent further movement of the governor rod 52. The governor will operate at speeds higher than this in the manner described above.

Figure 6:
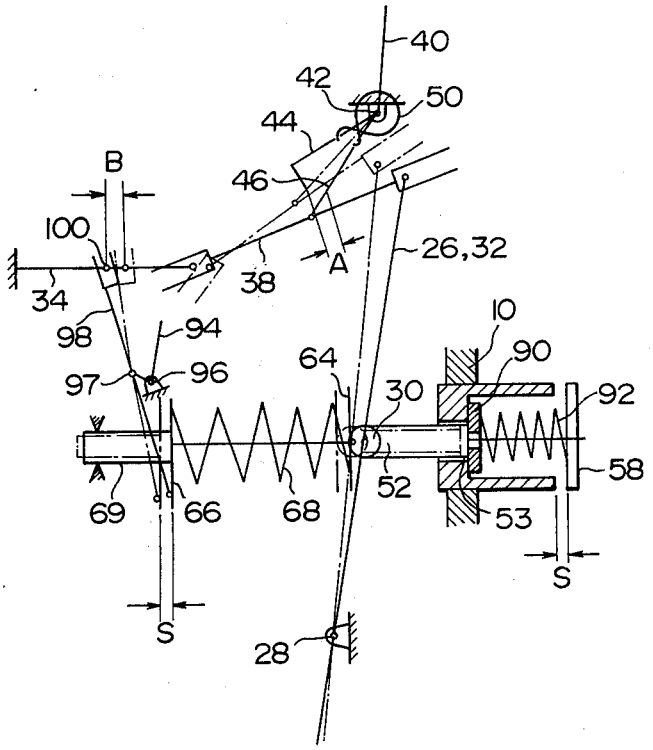
FIG. 6 is similar to FIG. 5 but shows the governor of FIG. 1 without the simplification and comprising the compensating spring and means for limiting the maximum fuel injection volume.

The embodiment of FIG. 6 is similar to those of FIGS. 1 and 5, and comprises, in combination, a mechanism for limiting the maximum fuel injection volume. The governor rod 52 is formed with a shoulder 53 which is arranged to abut against a spring seat 90 which is held against the housing 10 by a compensating spring 92 disposed between the nut 58 and the spring seat 90 in a preloaded state. The clearance S is provided as in the embodiment of FIG. 5, and the governor rod 52 is prevented from excessive rightward movement by the abutment of the shoulder 53 against the spring seat 90.

The governor also comprises a load control lever 94 which is pivotal about a pin 96. Although not shown, the load control lever 94 may be actuated automatically by means such as a diaphragm assembly responsive to the engine induction air pressure. The load control lever 94 may be rotated to a maximum clockwise position to shut down the engine.

A lever 98 is pivotally connected to the load control lever 94 by a pin 97, and is pivotaly connected at its upper end to the fuel control rod 34 by means of a pin 100. The lower end of the lever 98 is engageable with the left end of the second spring seat 66.

The lever 98 serves to limit the maximum fuel injection volume during starting and idling of the engine to a value at which smoky exhaust has will not be produced. In the example of FIG. 6, the operator has moved the speed control lever 40 to its maximum fuel position for starting the engine, and the arm 46 is disengaged from the arm 44 as shown in solid line. As the engine speed rises and the compensating spring 92 is compressed as described above, the governor rod 52 and second spring seat 66 are moved leftward by the pin 30. This causes rotation of the lever 98 clockwise so that the pin 100 and thereby the fuel control rod 34 are moved rightward by a distance B from the maximum fuel position. The combined movement of the fuel control rod 34 and the tension lever 32 causes the arm 46 to be moved by an amount A as shown in broken line. It will be understood that with the fuel control rod 34 in its leftmost position and the arm 46 disengaged from the arm 44, movement of the tension arm 32 alone would not move the fuel control rod 34 under these conditions. With the engine speed in the upper part of the idling range and the fuel control rod 34 in the maximum fuel position, an excess of fuel would be supplied to the engine causing the emission of black smoke to pollute the environment. The lever 98, however, moves the fuel control rod 34 by the distance B in the decreasing fuel direction to reduce the amount of fuel injection to a non-polluting level.

Figure 7:
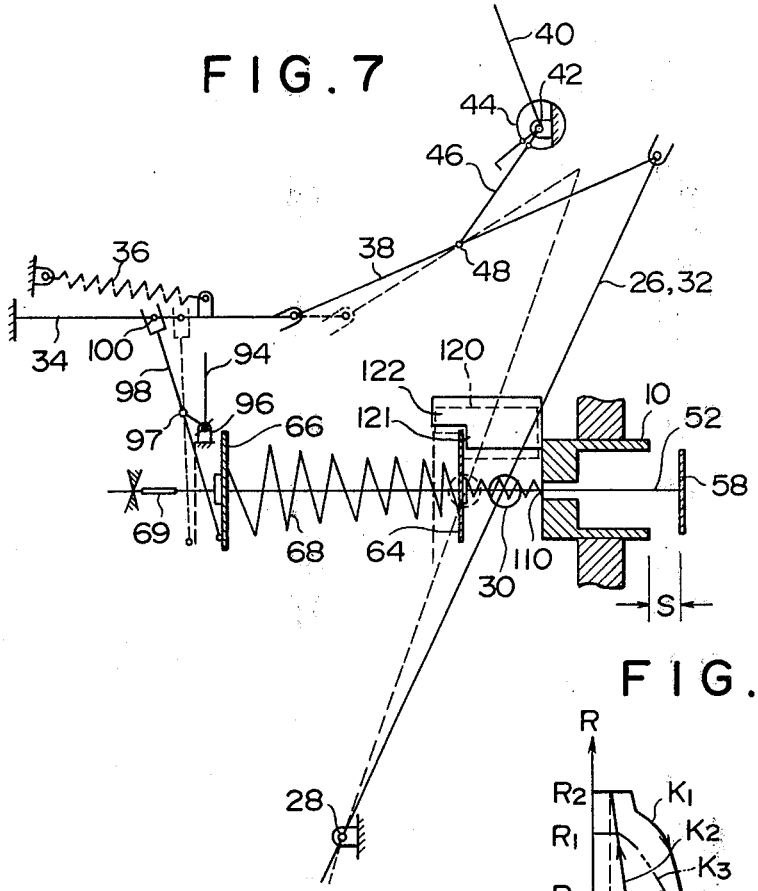
FIG. 7 shows a modified embodiment of the governor of FIG. 1 which comprises, in combination, means for limiting the maximum fuel injection volume and latching means for reducing the maximum fuel injection volume after the engine has been started.
Figure 8:
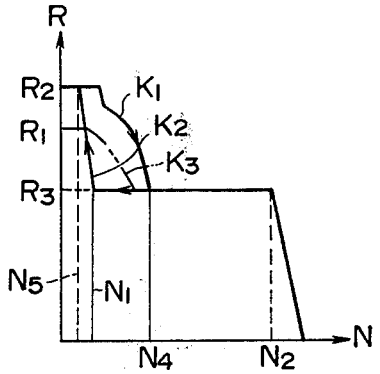
FIG. 8 is a graph illustrating the operation of the governor of FIG. 7.

Another embodiment of the present governor is shown in FIGS. 7 and 8. In this form there is no compensating spring, although one may be added if desired, and a weak spring 110 is provided to eliminate lost motion. In prior art governors, a cancelling spring is sometimes provided to oppose the starting spring 36 and prevent excessive fuel injection under idling conditions. Such a cancelling spring has the disadvantage that it prevents sufficient fuel from being injected into the engine for starting under some conditions, as shown by a broken line curve $K_3$ in FIG. 8, in which the maximum fuel injection volume is limited to a value $R_1$.

In accordance with the present invention, a latch mamber 120 is provided between the housing 10 and the spring seat 64. The latch member 120 has a lower left face 121 and an upper left face 122 which are engagable with the right side of the first spring seat 64.

The latch member 120 is normally biased upward as will be described below so that the spring seat 64 clears (is disposed below) the upper face 122. When the spring seat 64 is moved leftward by the distance S and the latch member 120 is moved downward from the solid line position to the broken line position, the upper face 122 of the latch member 120 will block the spring seat 64 to prevent rightward movement thereof.

Figure 10:
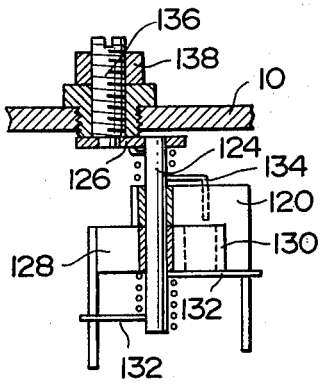
FIG. 10 is an overhead view of the latching means shown in FIG. 7.
Figure 9:
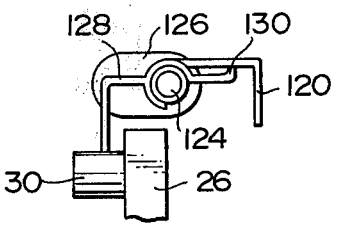
FIG. 9 is a side view of the latching means shown in FIG. 7.

Referring now to FIGS. 9 and 10, the latch member 120 is rotatably supported by a shaft 124 which is fixed to an arm 126. Integrally formed arms 128 and 130 are also rotatable on the shaft 124, and the latch member 120 is biased into engagement with the arm 130 by a spring 132. The latch member 120 and thereby the arms 128 and 130 are biased counterclockwise as viewed in FIG. 9 by a spring 134 so that the lower surface of the arm 128 is biased into engagement with the pin 30. The arm 126 is adjustably supported by the housing 10 by means of a threaded shaft 136 and a locknut 138. With this arrangement, counterclockwise rotation of the tension lever 26 in FIG. 7 will cause the pin 30 to move upwards and rotate the arms 128 and 130 and the latch member 120 clockwise as viewed in FIG. 9 so that the latch member 120 will be moved downward as viewed in FIG. 7.

As the spring seat 64 is moved leftward by the pin 30 as the engine speed increases, the pin 30 also causes rotation of the latch member 120 so that the portion of the latch member 120 between the faces 121 and 122 is urged into engagement with the top of the spring seat 64. The spring 132 yields to prevent breakage of the machanism. Leftward movement of the second spring seat 66 rotates the lever 98 clockwise to move the control rod 34 rightward to decrease the fuel injection volume against the force of the starting spring 36 and the idling spring 24. When the spring seat 64 has been moved by the distance S, the latch member 120 is snapped downward to a latching position so that the face 122 engages with the right side of the spring seat 64 to prevent rightward movement thereof. The control rod 34 is prevented from leftward movement by the lever 98, which is also effectively latched. This process is illustrated in FIG. 8 by a curve $K_1$. The nut 58 engages with the housing 10 at an engine speed $N_4$ which is higher than $N_1$ so that the governor spring 68 is compressed with a further increase in engine speed to provide a fuel injection volume corresponding to a fuel control rod 34 position $R_3$. In this manner a high fuel injection volume corresponding to $R_2$ is provided for starting.

Subsequently, with the spring seat 64 latched, the tension lever 26 will move against the force of only the idling spring 24 in the range between a stall speed $N_5$ and $N_1$, so that the pin 30 engages with the spring seat 64 at the speed $N_1$. At the stall speed $N_5$, the latch member 120 is rotated counterclockwise in FIG. 9 to the extent that it releases the spring seat 64 to return to its solid line position in FIG. 7. In this manner, the characteristic curve of FIG. 8 has a hysterisis form in that an excessive amount of fuel is provided only for starting the engine, and the fuel injection volume is automatically reduced once the engine is started to prevent the production of smoky exhaust gas.

Figure 11:
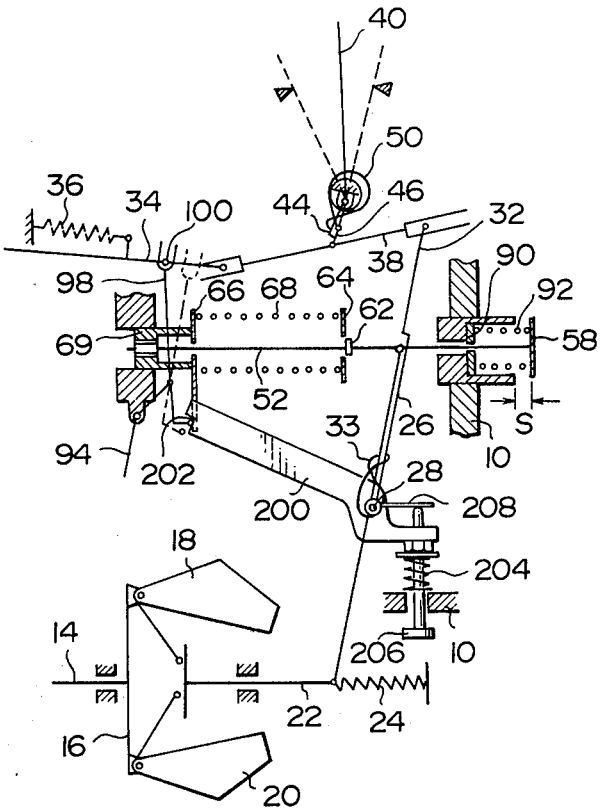
FIG. 11 is similar to FIG. 7 but shows alternative latching means.

FIG. 11 shows a similar mechanism which can be added to the embodiment of FIG. 6. A lever 200 has a left end face formed with a cutout 202. The right end of the lever 200 is urged to rotate counterclockwise by a spring 204. The spring 204 is retained by a bolt 206, the head of which is arranged to abut against the housing 10 upon upward movement thereof and the end of which is urged into engagement with an arm 208 integral with the tension lever 32 by the spring 204.

When the engine speed is below the stall speed $N_5$, the lever 200 is rotated clockwise against the force of the spring 204 by the arm 208 so that the cutout 202 engages with the lower end of the lever 98. The lever 98 may thereby assume its maximum fuel injection position which is shown in solid line in FIG. 11. As the engine speed approaches $N_4$, the tension lever 32 is rotated counterclockwise and the lever 200 is allowed to be rotated counterclockwise by the spring 204 so that the lower edge of the left end of the lever 200 above the cutout 202 engages with the bottom end of the lever 98 as shown. When the engine speed reaches $N_4$, the lever 98 is rotated clockwise to the extent that the left edge of the lever 200 is allowed to snap down to a latching position to engage with the bottom of the lever 98 to prevent counterclockwise rotation thereof from the broken line position of FIG. 11. Excessive counterclockwise rotation of the lever 200 is prevented by the head of the bolt 206. When the engine drops below $N_5$, the lever 200 is rotated clockwise by the arm 208 to release the lever 98. In this manner, a high fuel injection volume is provided for starting but the fuel injection volume is limited to a lower value when the engine speed reaches a selected value.

Figure 12:
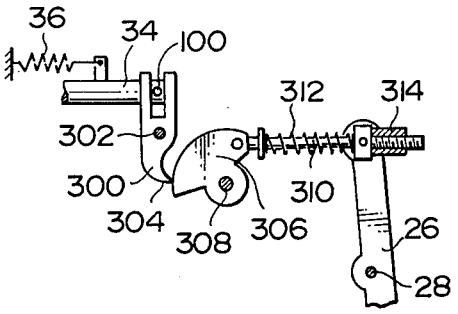
FIG. 12 is an enlarged side view of means for limiting the maximum fuel injection volume which comprises a cam.
Figure 13:
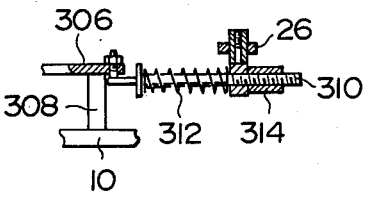
FIG. 13 is an overhead view of the means shown in FIG. 12.

FIGS. 12 and 13 show another mechanism which can be used to limit the maximum fuel injection volume as a function of engine speed. Such a mechanism is especially desirable in cases in which the speed control lever 40 is rapidly rotated for acceleration from low speed. The fuel injection volume corresponding to the position of the floating lever 38 would be excessive, but the fuel injection volume is limited to the correct value as a function of engine speed by the mechanism shown.

The mechanism comprises a lever 300 pivotal about a pin 302 and is connected to the pin 100 of the fuel control rod 34 in a manner similar to the lever 98, which is not used in this embodiment. The lever 300 is formed with a cam follower surface 304. A cam 306 is rotatable about a pin 308. The cam 306 is connected to the tension lever 26 by means of a rod 310. A nut 314 and spring 312 are provided for adjustment of the effective length of the rod 310.

Rotation of the tension lever 26 also causes rotation of the cam 306 in the manner of a double lever linkage. Since the cam follower surface 304 engages with the cam 306, the rotational position of the lever 300 is determined by the position of the cam 306 which is a function only of the engine speed. Specifically, leftward movement of the fuel control rod 34 causes counterclockwise rotation of the lever 300. The amount of counterclockwise rotation of the lever 300 is limited by the point at which the cam follower surface 304 abuts against the cam 306. The shape of the cam 306 is selected to provide the maximum fuel injection volume as a function of engine speed at which smoky exhaust gas is not produces.

Many modifications to the embodiments shown will become possible for those skilled in the art after receiving the teachings of the present disclosure without departing from the scope thereof.

What is claimed is:

1. A fuel injection pump governor comprising:

a housing;

a fuel control member;

a flyweight;

a linkage connecting the flyweight to the fuel control member;

a governor rod extending from within the housing and having an external end which is external of the housing;

a nut threaded on a portion of the governor rod which is inside the housing;

guide means for axially guiding the nut;

first and second spring seats slidably carried by the governor rod between the linkage and the nut; and a governor spring disposed between the first and second spring seats, the linkage being engageable with the first spring seat to move the first spring seat toward the nut so that the governor spring is compressed between the first and second spring seats as the rotational speed of the flyweights increases, whereby:

rotation of the external end of the governor rod produces axial movement of the nut.

2. The governor of claim 1, further comprising a shoulder formed on the governor rod between the first spring seat and the linkage.

3. The governor of claim 1, in which the guide means comprises an axial groove provided to the housing and a pin provided to the nut, the nut being axially slidably supported by the housing and the pin being slidable in the groove.

4. The governor of claim 1, further comprising an idling spring, the flyweight being arranged to move against a force of the idling spring as the rotational speed of the flyweight increases.

5. The governor of claim 1, further comprising a starting spring urging the fuel control member toward a maximum fuel position.

6. The governor of claim 1, in which the linkage comprises a tension lever means connected to the flyweight and a floating lever connected to the fuel control member, the tension lever means also being connected to the floating lever and being engagable with the first spring seat.

7. The governor of claim 6, in which the tension lever means comprises a first tension lever and a second tension lever, the first tension lever being connected to the flyweight and the second tension being connected to the floating lever, the tension lever means further comprising yieldable means rigidly connecting the first tension lever to the second tension lever in a fuel increasing direction and yieldably connecting the first tension lever to the second tension lever in a fuel decreasing direction.

8. The governor of claim 7, in which the yieldable means comprises biasing means urging the second tension lever to move in the fuel decreasing direction and a pin fixed to the first tension lever against which the second tension lever is abuttable.

9. The governor of claim 8, in which the first and second tension levers have a common pivot.

10. The governor of claim 6, further comprising speed control means arranged to move the floating lever.

11. The governor of claim 10, in which the speed control means is pivotally connected to an intermediate point of the floating lever to move the floating lever.

12. The governor of claim 11, in which the speed control means comprises a speed control member and yieldable means to rigidly connect the speed control member to the floating lever in a speed dicreasing direction and to yieldably connect the speed control member to the floating lever in a speed increasing direction.

13. The governor of claim 12, in which the yieldable means comprises a first arm connected to the speed control member, a second arm connected to the floating lever and biasing means urging the second arm in a fuel increasing direction toward abuttment with the first arm.

14. The governor of claim 1, further comprising a compensating spring urging the governor rod in fuel increasing direction.

15. The governor of claim 14, further comprising a retaining nut threaded to the external end of the governor rod, the compensating spring being disposed between the housing and the nut.

16. The governor of claim 15, in which the governor rod is formed with a shoulder, the governor further comprising a third spring seat slidably carried by the governor rod external of the housing between the shoulder and the retaining nut and being abuttable with the shoulder, the compensating spring being disposed between the third spring seat and the retaining nut.

17. The governor of claim 1, further comprising fuel limiting means movably actuated by the second spring seat and engagable with the fuel control member to limit movement of the fuel control member in a fuel increasing direction in dependence on a position of the second spring seat.

18. The governor of claim 17, in which the fuel limiting means comprises a lever having an intermediate pivot, one end of the lever being connected to the fuel control member and another end of the lever being engagable with the second spring seat.

19. The governor of claim 18, in which the fuel limiting means comprises a load control member connected to move the intermediate pivot of the lever.

20. The governor of claim 17, in which the fuel limiting means comprises a lever connected to the fuel control rod and having a cam follower, and a cam movable by the linkage, the cam follower engaging with the cam.

21. The governor of claim 18, further comprising latching means actuated by the linkage to latch the lever in a fuel limiting position when moved to the fuel limiting position by the second spring seat in response to the rotational speed of the flyweight exceeding a first predetermined value and to release the lever when the rotational speed of the flyweight subsequently drops below a second predetermined value which is lower than the first predetermined value.

22. The governor of claim 21, in which the latching means comprises a latching member and biasing means urging the latching member to latch the lever in the fuel limiting position, the linkage being arranged to move the latching member to release the lever when the rotational speed of the flyweight drops below the second predetermined value.

23. The governor of claim 21, in which the latching means is arranged to latch the lever through the first spring seat, governor spring and second spring seat.

24. The governor of claim 23, in which the latching means comprises a latching member and biasing means urging the latching member away from a latching position, the first spring seat being movable by the linkage in a fuel decreasing direction and the latching member being movable against a force of the biasing means to the latching position when the rotational speed of the flyweight exceeds the first predetermined value, the latching member in the latching position abuttingly preventing movement of the first spring seat in a fuel increasing direction until the rotational speed of the flyweight drops below the second predetermined value and the latching member is moved away from the latching position by the linkage.

25. The governor of claim 24, in which the latching member comprises a first arm engaging with the linkage, a second arm engagable with the first spring seat and yieldable means rigidly connecting the first arm to the second arm in a direction away from the latching position and yieldably connecting the first arm to the second arm in a direction toward the latching position.

26. The governor of claim 25, in which the yieldable means comprises a third arm integral with the first arm and biasing means urging the second arm into engagement with the third arm in a direction toward the latching position.

27. The governor of claim 25, in which the first and second arms have a common pivot.

28. The governor of claim 27, in which the latching means further comprises adjustment means for adjusting a position of the common pivot.

29. The governor of claim 24, in which the governor rod is provided with stopper means for limiting movement of the governor rod in the fuel decreasing direction.

* * * * *